United States Patent [19]

Hanstein et al.

[11] 4,222,210

[45] Sep. 16, 1980

[54] CONVERSION MUNTINS FOR GLAZING FRAMES

[75] Inventors: Friedrich Hanstein, Gross-Zimmern; Theodor P. Moench, Gross-Umstadt-Heubach, both of Fed. Rep. of Germany

[73] Assignee: Röhm GmbH, Darmstadt, Fed. Rep. of Germany

[21] Appl. No.: 10,537

[22] Filed: Feb. 8, 1979

[30] Foreign Application Priority Data

Feb. 25, 1978 [DE] Fed. Rep. of Germany ..... 2808155
May 10, 1978 [DE] Fed. Rep. of Germany ..... 2820306

[51] Int. Cl.[2] ..... E04C 1/34

[52] U.S. Cl. ..... 52/461; 52/469; 52/727; 52/772

[58] Field of Search ..... 52/461, 469, 770, 772, 52/773, 727

[56] References Cited

U.S. PATENT DOCUMENTS

| | | | |
|---|---|---|---|
| 1,793,127 | 2/1931 | Osius | 52/772 |
| 3,688,460 | 9/1972 | Jacobus | 52/468 |

FOREIGN PATENT DOCUMENTS

| | | | |
|---|---|---|---|
| 1105961 | 12/1955 | France | 52/461 |
| 1266593 | 6/1961 | France | 52/461 |
| 1447831 | 6/1966 | France | 52/772 |
| 535307 | 4/1941 | United Kingdom | 52/772 |
| 942774 | 11/1963 | United Kingdom | 52/461 |
| 1011881 | 12/1965 | United Kingdom | 52/461 |

*Primary Examiner*—Price C. Faw, Jr.
*Assistant Examiner*—Henry E. Raduazo
*Attorney, Agent, or Firm*—Curtis, Morris & Safford

[57] ABSTRACT

What is disclosed is a conversion muntin for use on a glazing muntin to adapt the latter to support light-transmitting plastic panels, including a muntin cover element and a clamping strip. The cover element has a T-shaped configuration including a recessed stem portion and a pair of oppositely extending bearing arms. The stem is recessed to receive a portion of the glazing muntin and has a plurality of longitudinally-extending grooves formed therein. The clamping strip comprises a pair of elongated parallely-extending rails and a hood integrally formed therewith and adapted to receive the stem of the conversion muntin. The rails have oppositely-facing slightly-spaced lips which receive the conversion muntin stem therebetween and which engage said grooves to hold light-transmitting panels against the bearing arms of the conversion muntin.

13 Claims, 4 Drawing Figures

CONVERSION MUNTINS FOR GLAZING FRAMES

Figure 1:
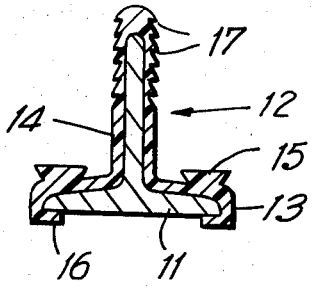

The present invention relates to conversion muntins for glazing frames, and relates particularly to conversion muntins which are suitable for adapting conventional muntins of inverted T structure to accommodate multiple-walled plastic panels, instead of simple glass panes.

For some time there has been a tendency, in the field of horticulture and industry as well as in the private sector, to replace silicate glass glazing which has been damaged (or is threatened with damage) by the action of the weather, and in particular by hail or other mechanical action, with plastic glazing. In addition to this, single glass panes are being replaced more and more frequently by transparent multilayer plastic panes in order to obtain better heat insulation.

Particularly for this purpose, there are available glazings of sandwich-type, rib-reinforced, sheets, plates, or panels, particularly the so-called ribbed double-walled panels or ribbed triple-walled panels.

Such multiple-walled panels of resistant, light-transmitting plastics, such as of polyvinylchloride, polyethylene, polystyrene, polyamides, polyformaldehyde, particularly polyacrylates, polymethacrylates, and polycarbonates, as well as copolymers and polymer mixtures, already find extensive use in construction and illumination engineering.

Ribbed double-wall panels can, for instance, be described as extruded, flat, hollow panel units having two relatively thin outer walls forming the outer surfaces of the panels and a plurality of intermediate stiffening walls —the so-called ribs—arranged as a rule parallel to each other and to the edges of the panel.

In the customary ribbed double-walled panels, the width of the hollow unit is generally at least one to two powers of 10 greater than the height of the unit; the distances between the ribs are on the same order of magnitude as the height of the units.

The current dimensions of commercial light-transmitting ribbed double-walled panels are, for instance, unit heights of about 8 to 40 mm and a rib spacing of about 16 to 40 mm. The arrangement described results in a substantially improved stiffness to bending and sagging and in generally improved mechanical properties as compared with solid panels of the same weight (see German Unexamined application for Patent DE-OS No. 1,609,777), as well as substantially better heat insulation.

The dimensions, particularly the panel widths, are in general directed towards a given type of product or end use; they can be varied within certain limits. It may be mentioned in particular that ribbed double-walled panels with wall thicknesses of slightly more than 1 mm already provide very satisfactory mechanical properties, particularly a high rigidity and excellent heat insulation.

For replacement of silicate glass panes in the aforementioned glazings customarily in use in the field of horticulture and industry, ribbed double-walled panels having panel widths cut for this end use have recently been offered. However, it was by no means possible to replace existing single-pane (silicate) glass directly with the ribbed double-walled panels offered, since the traditional fastening systems are as a general rule not suitable to receive substantially thicker materials.

The aforementioned glazing systems in the field of horticulture and industry, in which silicate glass panes are to be replaced by plastic glazing and in particular by multiple units such as the ribbed double-walled panels, as a rule comprise a framework of metallic inverted T-shapes which are separated by a standard distance (600 mm).

As a general rule these inverted T-shapes have a height which, while sufficient to receive a bed of putty and a silicate glass pane of the conventional type, is not sufficient for fastening the aforementioned ribbed double-walled panels, which are offered with unit heights of, for instance, 8 mm, or a multiple of this value.

Accordingly to the present invention, it has been found that light-transmitting multiple-walled panels of the type described above, and particularly ribbed double-walled panels of suitable dimensions, can be permanently and interchangeably fastened on the inverted T-shape frame-supports heretofore customary for silicate glazing units, while retaining the support system already present, by means of a conversion muntin.

Figure 2:
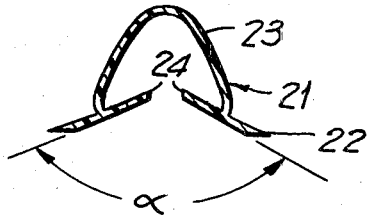
Figure 3:
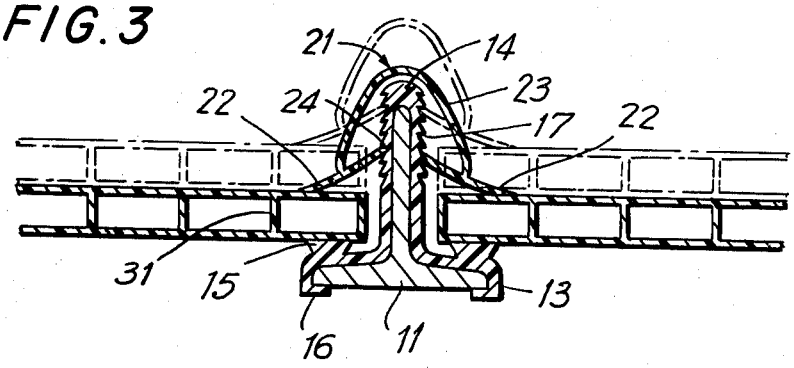
Figure 4:
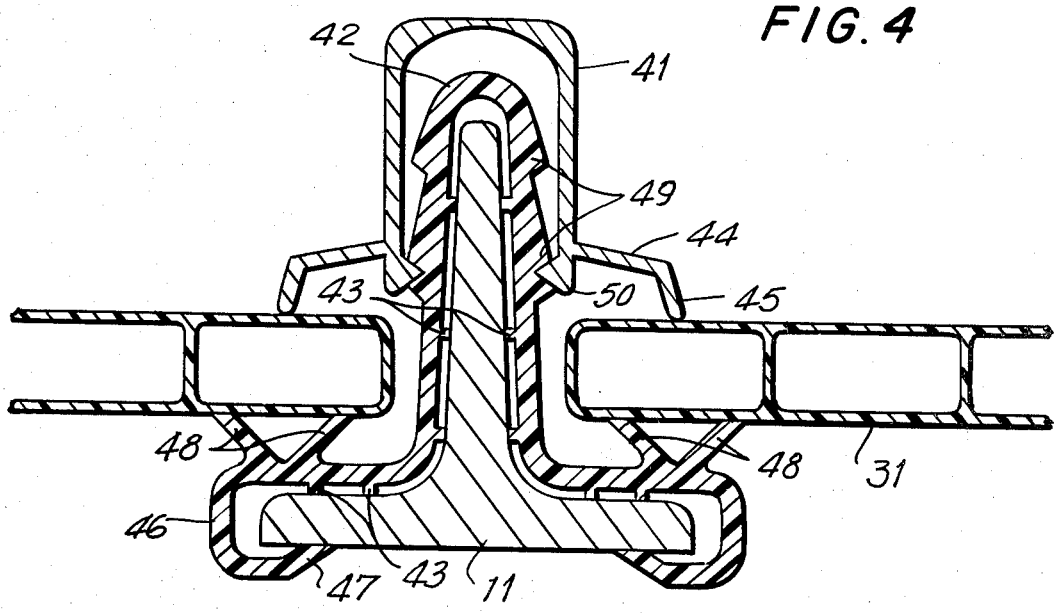

A better understanding of the present invention and of its many advantages will be had by referring to the accompanying drawings, in which FIG. 1 is an end view, in section, of a first embodiment of a conversion muntin according to the present invention, mounted on a standard inverted T frame;

FIG. 2 is an end view, in section, of a cover-clamp element which cooperates with the muntin of FIG. 1 to affix plastic glazing to a window frame;

FIG. 3 is an end view, in section, of the muntin and cover-clamp element of FIGS. 1 and 2 used to affix a ribbed double-walled plastic glazing panel to a conventional window frame of inverted T construction; and FIG. 4 is an end view, in section, of further embodiments of the conversion muntin and cooperating cover-clamp element used to affix a ribbed double-walled plastic glazing panel to a conventional window frame of inverted T construction.

More in particular, FIG. 1 shows conventional muntin 11 over which is present conversion muntin 12 according to the present invention. Muntin 12, suitably of plastic and which is preferably so shaped that its inner surface closely fits the contours of muntin 11, comprises two side-arm portions 13 and raised vertical leg portion 14. Side-arms 13 each comprise continuous bearing surface 15 and are shaped in their bottom portions 16 sufficiently to serve as a clamp helping to hold conversion muntin 12 on conventional muntin 11. Leg 14 is provided in upper portions thereof with plurality of sawtooth-like depressions or grooves 17 which are symmetrical on both sides of leg 14 and extend parallel to the length of muntin 12.

FIG. 2 shows cover-clamp element 21, suitably of plastic, comprising a pair of longitudinally-extending rails 22 connected by hood 23 and inclined to each other, at least in the region of hood 23, at an obtuse angle, $\alpha$. The edges of rails 22 opposed within hood 23 terminate in lips 24 which are adapted to engage with grooves 17 of the conversion muntin of FIG. 1. Cover-clamp 21 is suitably symmetric across a vertical plane extending the length of the element.

FIG. 3 shows the cover-clamp element of FIG. 2 engaged with the conversion muntin of FIG. 1 to mount ribbed double-walled plastic glazing panel 31 to conventional muntin 11 of inverted T construction. The broken lines in FIG. 3 show how the same arrangement will also accommodate a plastic glazing panel having twice the (unit) height of panel 31.

The embodiment just described is particularly suitable, as can be seen, for converting existing support systems with inverted T-shapes in order to glaze them with plastic multiple-walled panels. However, T-shape supports of the type customary on the market can also be equipped in advance with muntins 12 according to the invention and be used for glazing.

The placing of the conversion muntin of the invention over the inverted T-shapes can be effected in an immediately evident manner by placing the plastic muntin 12 over the T-shape from its end. When converting support frames which previously bore silicate glazing, the operation is advisedly preceded by putty removal using a conventional putty-removing machine or by burning off the putty, for instance with a blowtorch.

In the embodiment described above, muntin 12 is preferably made of a suitable, stable, weather-resistant plastic which preferably has a certain amount of elasticity, for instance (modified) PVC, polypropylene, or polyamide, and can be produced, for instance, by extrusion. The "inner" dimensions of the muntin, as already pointed out, are dictated by the dimensions of the T-shapes which are to be covered. The cross arm of the inverted T-shape frequently has a total width of 30–35 mm while the vertical leg is about 35–40 mm high. The thickness of the wall of the plastic muntin 12 can be from about 0.8 to 1.2 mm, depending on the nature and quality of the plastic, except at places which are thickened because of their function. The height of the continuous bearing surface 15 (including the thickness of the cover) is as a rule about 2 to 4 mm.

The bearing surface 15 can be shaped, as shown in FIGS. 1 and 3, in known manner as a single element, but can also be shaped to have plural elements, for example as two supporting elements which come together in a V-shape.

Referring again to FIG. 3, after suitably-dimensioned multiple-layered panels, and in particular ribbed double-walled panels such as 31, are laid on the bearing surfaces 15 of the conversion muntin 12, mounted on T-shaped frame 11, the cover-clamp 21 is pressed, commencing from an end, under slight pressure, with widening of the angle $\alpha$, onto the vertical leg 14 of muntin 12, whereby the outer edges of rails 22, which are connected to each other by hood 23, are caused to sit, in a continuous line, on the surface of panel 31. Cover-clamp 21, as can easily be noted, is held in place by the snapping of lips 24 of rails 22, firmly connected with each other by hood 23, into sawtooth-shaped depressions 17 of muntin 12. From the manner of operation of the conversion muntin of the invention, it is clear that the dimensions of the device, particularly the heights, are predetermined by the height of the vertical leg of the inverted T-shape, the thickness of the bearing surface 15 (including the thickness of the covering), and by the thickness of the multiple-walled panel 31 when cover-clamp 21 has been placed in a functionally proper manner on conversion muntin 12, i.e. when, in the embodiment described above in which angle $\alpha$ has been widened, the apex of hood 23 is preferably still at a certain spaced distance from the tip of vertical leg 14 mounted on the upright portion of the inverted T frame 11.

The device according to the invention is excellently suited for holding the different multiple-walled panels which are available. For example, provided that the distance between lips 24 and the apex of hood 23 of cover-clamp strip 21 is suitably selected (the former about 16 mm, the latter about 8 mm), both ordinary commercial ribbed double-walled panels of a thickness of 8 mm and panels having a thickness of 16 mm can be held (cf. broken lines in FIG. 3).

In the embodiment of FIGS. 1–3 described above, the cover-clamp strip 21 is also suitably made of a weather-resistant, stable and if possible white, plastic which advantageously has a certain elasticity with low relaxation, for instance (modified) PVC, polypropylene, or polyamide, etc. Its thickness to a certain extent—as a function of the nature and quality of the material used—will be about 0.3 to 1 mm. The width of the individual rails 22 which are connected with each other by hood 23 is, as a rule, greater than half the length of the cross arm of the inverted T-frame to be converted.

In accordance with another particularly advantageous development of the invention, FIG. 4 shows cover-clamp strip 41 made, in whole or in part, of a suitable metal. It is particularly advisable to use light metal, especially aluminum, which can possibly also be surface-treated or protected in known manner. Otherwise, the shape of muntin 42 of this embodiment corresponds largely with the description given earlier. However, ribs 43 of slight thickness are advantageously arranged, preferably symmetrical to each other, on the inner surface of muntin 42 at suitable distances apart. Cover-clamp strip 41, made of a suitable metal, can be shaped such that rails 44 thereof are bent downwardly in their outer region 45.

The portion 46 of muntin 42 which covers the cross arm of the T-shaped conventional muntin 11 need not in all cases be completely formed, but only to such an extent that it acts as clamp. End sections 47, for this reason, suitably press tightly against the bottom of the cross arm.

Muntin 42 in this case also is suitably made of a stable, weather-resistant plastic which advantageously has a certain amount of elasticity. Its "inner" dimensions are essentially dictated by the dimensions of the T-shape which is to be covered. The thickness of the wall of muntin 42 can, as a rule, be from about 0.8 to 1.2 mm, as a function of the nature and quality of the plastic, except for the points which are thickened because of their function. The two bearing surfaces 48, which advantageously consist of several bearing elements, serve, in combination with the two downward curved or bent edges 45 of the two rails 44, to hold light-transmitting multiple-walled panels 31 and at the same time for sealing and/or heat insulation.

The height of bearing surfaces 48, which are formed from several bearing elements, (within which dimension there are also to be included the thickness of the plastic and the height of ribs 43 in this region) is in a functional relationship with the distance of sawtooth-like grooves 49 from the bearing surface 48, on the one hand, and edges 45 of rails 44 and lips 50 which fit in sawtooth-like grooves 49, on the other hand, in such a manner that the distance between edges 45 and bearing surface 48 will correspond to the thickness of light-transmitting multiple-walled panels 31, possibly taking a certain deformability of bearing surfaces 48 into consideration. The dimensions of metallic cover-clamp strip 41 are also dictated by the functional relationships discussed above.

In a preferred embodiment of the invention, bearing surfaces 48 consist of two bearing elements which come together in V-shape, but other shapes and arrangements of the bearing surfaces are also possible. For example, rails 44 are advantageously so dimensioned that their edges 45 sit on light-transmitting multiple-walled panel 31 above the center of the bearing supports, for instance in the center between the two bearing elements which come together in V-shape.

By the provision of a plurality of suitably spaced sawtooth-like grooves 49 on both sides of that portion of muntin 42 which covers the vertical leg of conventional muntin 11, the conversion muntins of the invention are adapted to receive light-transmitting multiple-walled panels 31 of different thicknesses, for instance ribbed double-walled panels having a thickness of 8 mm or 16 mm.

The mounting of the conversion muntin of FIG. 4 is effected, in this case also, in extremely simple manner by pushing the conversion muntin over the T-shaped frame which, if it previously bore a silicate glazing, has first been freed of putty. However, T-shape supports of commercial type can also be equipped in advance with plastic muntins according to the present invention and used for glazing. After suitably dimensioned multiple-walled panels, particularly ribbed double-walled panels such as 31, have been placed on the bearing surfaces 48 consisting of several bearing elements, cover-clamp strip 41 is pulled on, its lips 50 engaging into sawtooth-like grooves 49 of the plastic muntin 42.

The device of the invention for holding plastic multiple-walled panels tolerates a certain variation in the width of the panels which are to be laid and, for instance, takes into account their expansion upon heating, without losing its efficiency.

The conversion muntins of the invention have many advantages. They can be rapidly and easily mounted and replaced are are tight and corrosion-resistant. They are suitable for use with a large number of commercial transparent multiple-walled panels, particularly with ribbed double-walled panels of different thicknesses. Further, it is important that the device according to the invention no longer presents any cold bridges as was true of the corresponding elements of traditional glazing. A particular advantage of the device of the invention is that, in contrast to the conventional silicate glazing units which it replaces, it has an excellent heat-insulating action.

Also, the protection of the edge regions of the light-transmitting multiple-walled panels which is afforded by the metal cover-clamp strip can be of particular importance.

What is claimed is:

1. A conversion muntin for use on a T-shaped glazing muntin to adapt the latter to support a light-transmitting panel, said T-shaped glazing muntin having a stem and a cross-piece defining a pair of bearing surfaces for said panels, said conversion muntin comprising a muntin cover element having a generally T-shaped configuration including a recessed stem and a pair of oppositely extending bearing arms, said recessed stem being adapted to receive the stem of the glazing muntin with said bearing arm overlying the bearing surfaces of the glazing muntin, said bearing arms each having continuous panel support elements formed on the sides thereof opposite said bearing surfaces of the glazing muntin and having free ends including means for clamping the cover element to the edges of the cross-piece of the glazing muntin, said clamping means being spaced from one another to define an opening therebetween providing access to said recessed stem to allow insertion of the glazing muntin into the cover element, said recessed stem of the muntin cover element having a plurality of longitudinally-extending grooves formed therein on both sides thereof; and a clamping strip adapted to be mounted on said recessed stem to hold a light-transmitting panel against said panel support elements, said clamping strip comprising a pair of elongated parallely-extending rails and a hood integrally formed therewith to receive a portion of said recessed stem, said rails having oppositely-facing slightly-spaced longitudinally-extending lips and being joined to said hood to form an obtuse angle therebetween opening towards said muntin cover element to receive therebetween said recessed stem and allow said lips to be engaged in said grooves.

2. A conversion muntin as defined in claim 1 wherein said bearing arms of the cover element include means for clamping the cover element to the cross-piece of the glazing muntin.

3. A conversion muntin as defined in claim 1 wherein each of said panel support elements comprises a pair of angularly-related ribs formed on the bearing arms defining a generally V-shaped support opening towards the cover element.

4. A conversion muntin as defined in claim 1 wherein said stem has a plurality of sawtooth longitudinally-extending ribs formed on both sides thereof defining said grooves therebetween.

5. A conversion muntin as defined in claim 1 wherein said cover strip is formed of a light, metal.

6. A conversion muntin as defined in claim 1 wherein said rails have outer longitudinally-extending edge portions which are bent downwardly toward said glazing support elements and are dimensioned to generally overlie said glazing support elements.

7. A conversion muntin as defined in claim 1 wherein said recessed stem of the cover element has longitudinally-extending internal ribs formed thereon for engaging said stem of the glazing muntin.

8. A conversion muntin as defined in claim 1 wherein said cover strip is formed of a flexible plastic material.

9. A conversion muntin for use on a glazing muntin to adapt the latter to support a light-transmitting panel, said conversion muntin comprising a muntin cover element having a generally T-shaped configuration including a recessed stem portion and a pair of oppositely-extending bearing arms, said recessed stem being adapted to receive a portion of said glazing muntin, said bearing arms each having continuous panel support elements thereon parallel to said stem and having free ends including means for clamping the cover element to the edges of the cross-piece of the glazing muntin, said clamping means being spaced from one another to define an opening therebetween proving access to said recessed stem to allow insertion of the glazing muntin into the cover element, said stem having a plurality of generally saw toothed shaped longitudinally-extending ribs formed thereon defining longitudinally-extending grooves in the stem on both sides thereof; and a clamping strip adapted to be mounted on said stem to hold a light-transmitting panel against said support elements, said clamping strip comprising a pair of elongated parallely-extending rails and a hood integrally formed therewith and adapted to receive said stem, said rails having oppositely-facing slightly-spaced lips and being joined to said hood to form an obtuse angle therebetween opening towards said muntin cover element to receive said stem therebetween and to allow said lips to be engaged in said grooves.

10. A conversion muntin as defined in claim 9 wherein said cover element is formed of plastic and said recessed stem is dimensioned to slidably receive said portion of the glazing muntin.

11. A conversion muntin as defined in claim 10 wherein said cover element includes means for clamping the cover element to the glazing muntin..

12. A conversion muntin as defined in claim 9 wherein said rails have outer edge portions which are bent downwardly toward said support elements and are dimensioned to overlie said support elements.

13. A conversion muntin as defined in claim 12 wherein each of said panel support elements comprises a pair of angularly related ribs formed on said bearing arms defining a generally V-shaped support opening towards said cover element.

* * * * *